US009314918B2

(12) United States Patent
Wilbs

(10) Patent No.: US 9,314,918 B2
(45) Date of Patent: Apr. 19, 2016

(54) DEVICE HOLDER

(75) Inventor: Thomas Wilbs, Uhlingen-Birkendorf (DE)

(73) Assignee: ALFER ALUMINUM GESELLSCHAFT MBH, Wutoschingen (DE)

( * ) Notice: Subject to any disclaimer, the term of this patent is extended or adjusted under 35 U.S.C. 154(b) by 144 days.

(21) Appl. No.: 13/698,086

(22) PCT Filed: May 26, 2011

(86) PCT No.: PCT/DE2011/075119

§ 371 (c)(1),
(2), (4) Date: Nov. 15, 2012

(87) PCT Pub. No.: WO2012/025107

PCT Pub. Date: Mar. 1, 2012

(65) Prior Publication Data

US 2013/0056596 A1 Mar. 7, 2013

(30) Foreign Application Priority Data

Jun. 1, 2010 (DE) ..... 10 2010 017 186

(51) Int. Cl.
*B25H 3/04* (2006.01)
*A47L 13/512* (2006.01)

(52) U.S. Cl.
CPC ..... *B25H 3/04* (2013.01); *A47L 13/512* (2013.01)

(58) Field of Classification Search
CPC ..... A47L 13/512; B25H 3/04; F16B 2/10; A47K 1/09; A47G 23/0241
USPC ..... 248/113, 312, 313, 205.1, 229.13, 248/229.23, 228.4, 230.4, 231.51, 316.5, 248/316.7, 111; 211/60.1, 70.6, 62–63, 211/65–66, 69.8, 69.9, 70.2, 89.01; 24/512, 24/537
See application file for complete search history.

(56) References Cited

U.S. PATENT DOCUMENTS

| | | | | | |
|---|---|---|---|---|---|
| 338,248 | A | * | 3/1886 | Capron | 248/113 |
| 504,887 | A | * | 9/1893 | Moore | 248/113 |
| 768,122 | A | * | 8/1904 | Hamilton | 248/316.5 |
| 873,762 | A | | 12/1907 | Lyons | |
| 1,073,679 | A | * | 9/1913 | Haussman | 248/316.5 |
| 1,589,818 | A | * | 6/1926 | Ritter | 248/113 |

(Continued)

FOREIGN PATENT DOCUMENTS

| | | |
|---|---|---|
| DE | 89 15 118 U1 | 2/1990 |
| DE | 20 2006 009 550 U1 | 9/2006 |

(Continued)

*Primary Examiner* — Ingrid M Weinhold
(74) *Attorney, Agent, or Firm* — Notaro, Michalos & Zaccaria P.C.

(57) ABSTRACT

Device holder for clamping long-handled devices subject to gravity, has a carrier to be fastened to a wall, a pair of clamping scissors reversibly pivoted relative to the carrier from horizontal to vertical positions, the scissors having two scissor legs moved relative to each other and rotatably arranged at a bent end on the carrier side. Free legs of the scissor legs cross one another and form a device receptacle. For the device holder to securely hold the device and to remain functional for a long time, in the area of the receptacle the scissor legs are always in a plane having a line of intersection with the clamp carrier plane that is horizontally oriented, and at least one scissor leg limits at least the pivoting motion of the other scissor leg into the clamping position by a stop.

6 Claims, 3 Drawing Sheets

(56) References Cited

U.S. PATENT DOCUMENTS

Figure 1:
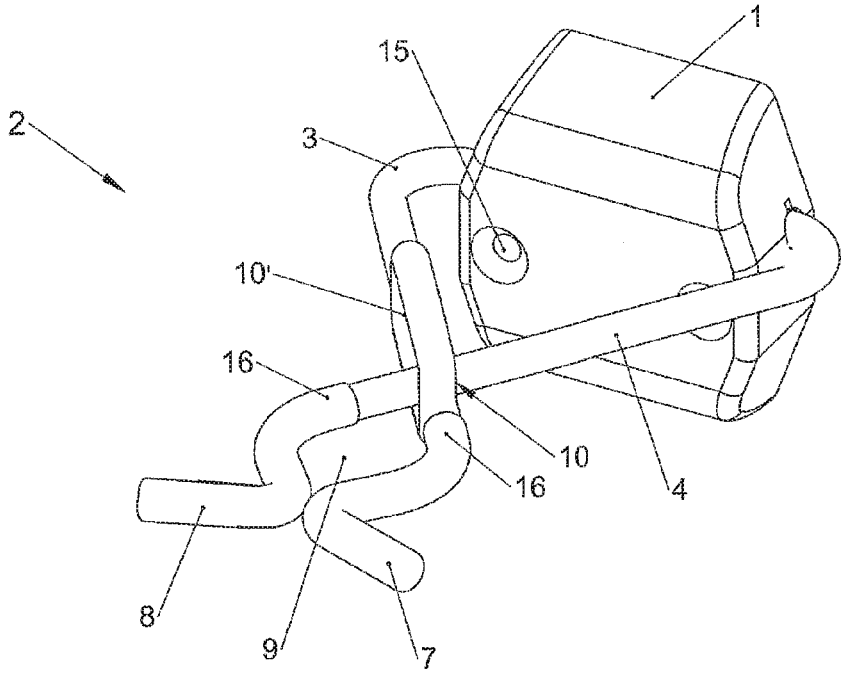

| | | | | | |
|---|---|---|---|---|---|
| 1,703,008 | A | * | 2/1929 | Justice | 248/113 |
| 1,837,277 | A | * | 12/1931 | Lund | 606/110 |
| 2,284,004 | A | * | 5/1942 | McCurdy | 292/20 |
| 4,192,315 | A | * | 3/1980 | Hilzinger et al. | 606/158 |
| 4,318,525 | A | * | 3/1982 | Welch | 248/228.7 |
| 4,738,424 | A | * | 4/1988 | Conner | 248/340 |
| 4,765,335 | A | * | 8/1988 | Schmidt et al. | 606/158 |
| 4,909,467 | A | * | 3/1990 | Shan-Pao | 248/312 |
| 4,966,344 | A | * | 10/1990 | Gary | 248/317 |
| 5,116,003 | A | | 5/1992 | Gerhardt | |
| 5,322,256 | A | | 6/1994 | Kanwischer | |
| 5,535,970 | A | * | 7/1996 | Gobbi | 248/74.2 |
| 6,251,117 | B1 | * | 6/2001 | Kringel et al. | 606/158 |
| 6,254,053 | B1 | * | 7/2001 | Taser | 248/313 |
| 6,273,387 | B1 | * | 8/2001 | Miller | 248/317 |
| 6,612,532 | B1 | * | 9/2003 | Paulus | 248/317 |
| 2006/0224170 | A1 | * | 10/2006 | Duff | 606/157 |

FOREIGN PATENT DOCUMENTS

| | | |
|---|---|---|
| DE | 10 2008 006 439.4 | 7/2009 |
| EP | 0 180 884 | 11/1988 |

* cited by examiner

DEVICE HOLDER

The present invention relates to a device holder for clamping long-handled devices under the effect of gravity according to the preamble of claim 1.

Device holders are required for suspending work equipment, preferably those with a handle, and should be as simple as possible to actuate, most preferably by the implement to be suspended itself without the assistance of a hand of an operator. It is known to use gravity for this purpose, which on the one hand facilitates the closure of the device holder around the implement to be held and also applies the retaining force.

Such a device holder is known from EP 0 180 884 B2. This comprises a clamp carrier that can be fastened to a wall and a pair of clamping scissors that can be reversibly pivoted with respect to the clamp carrier from a horizontal closed position to a vertical open position. The clamping scissors consist of two scissor legs, which are rotatably arranged in the clamp carrier at a bent end on the clamp carrier side, the free legs of which cross one another and define a device receptacle therebetween. The closing movement of this known device is delimited by a displaceable ring about both scissor legs at their crossing point. A disadvantage with this prior art is that the crossing scissor legs lie in a skew plane so that suspended implements experience a force due to the vertically spaced-apart contact points of the scissor legs on the implement which makes them pivot away laterally and therefore hang skew in the device holder. This makes it easy for the implements to fall out from the holder and leads to a non-secure suspension. At the same time, opening damage to the ring would lead to this known device holder being unusable since the scissor legs could then pivot past one another. Finally jamming of ring and scissor legs can occur which makes the known device holder unusable.

A device holder for clamping long-handled devices under the effect of gravity is therefore known from DE 20 2006 009 550 U1 in which the scissor legs are guided vertically by means of a slotted link in the clamping part and their subsequent downwards movement is delimited by a stop. In this known device holder the scissor legs lie in a horizontal plane and do not cross. The simultaneous movement of both scissor legs is forced by a spacer which is disposed between them and which guides them. If this is damaged, a problem-free functionality of the device holder is no longer given since the scissor legs are movable separately from one another so that a hand must be taken for assistance during suspension. At the same time, when used for a longer time, the stop on the clamping part side can be knocked out by heavy devices.

It is therefore the object of the present invention to provide a device holder which securely holds the devices and remains functional for a long time.

This object is solved whereby in the area of the device receptacle the scissor legs are always in a plane having a line of intersection with the clamp carrier plane that is horizontally oriented, and that at least one scissor leg limits at least the pivoting motion of the other scissor leg into the clamping position by means of a stop. If the scissor legs in the area of the device receptacle always lie in a plane having a line of intersection aligned horizontally with the clamp carrier plane, it is advantageously ensured that the scissor legs in the clamped state lie parallel to one another and in an approximately horizontal plane. By this means a device clamped between said scissor legs is held without torque so that it hangs straight downwards, cannot pivot away laterally and therefore cannot slip easily from the clamping. This advantage of the invention compared with the prior art is further intensified in that according to the invention, the scissor legs are used to mutually guide and limit the pivoting movement. As a result, on the one hand an additional component as required in the prior art can advantageously be omitted, and on the other hand the clamp carrier can be constructively simplified and need not fulfill any further functions. According to the invention, at least one scissor leg should delimit the pivoting movement of the other by means of a stop, naturally a mutual limitation is also feasible. The stop in this case can be configured in any form according to the invention, for example, as a placed-on or moulded-on stop lug, as a flank, by surface profiling or the like.

In one embodiment of the invention, it is provided that at least one scissor leg forms a motion link for the other scissor leg, in particular comprises a cranked section. This configuration very advantageously has the result that the second leg is more or less guided restrictedly by the first and therefore can only change its relative position with respect to the first scissor leg with difficulty, which promotes the safety of the clamping. One embodiment of this motion link according to the invention is a cranked section, in which the other scissor leg is guided and at the flanks whereof respectively one motion-limiting stop or abutment is located.

It is particularly advantageously provided according to the invention that the free legs of the clamping scissors are configured to be penetrating each other. Here according to the invention primarily a penetration of the mutual positional planes of the scissor legs and less a material penetration is meant. This penetration is primarily achieved by one or both scissor legs having a section curved away from the other scissor leg.

A particularly simple but effective configuration of the invention is that in which one clamping scissors has an oblong hole through which the second clamping scissors passes. Such an oblong hole is simple to produce and provides a completely enclosed link path so that the second scissors can only escape from its restricted guidance after a material rupture. The walls on the narrow sides of the oblong hole thereby form stops which delimit the movement path of the scissor leg guided in the oblong hole.

If the oblong hole is formed by an oblong hole sleeve consisting of plastic or metal, that is inserted in the scissor leg, a simple method of production is advantageously given. The connection of the separately manufactured oblong hole sleeve to the scissors leg can be accomplished according to the invention by gluing, welding, clipping, screwing or riveting. In the case of screwing, an external thread would need to be provided on the scissor leg complementary to an internal thread in the elongate hole sleeve.

The design in which the oblong hole is inserted in the material of the scissor leg, for example, by slitting, is particularly simple.

In one embodiment of the invention, it is provided that the pair of clamping scissors is pivotable against a counterforce into the open position. Such a counterforce prevents the clamping scissors from remaining in the opened perpendicular state and must be pushed by hand to move into the clamping position. In addition, such a counterforce strengthens the gravity-dependent clamping force and therefore contributes to an even safer holding of the clamped devices.

If the counterforce acts on at least one end of the scissor leg on the clamp carrier side, the lever is minimal but the constructive incorporation in the device holder is simplified since it can be disposed in the clamp carrier.

The invention advantageously provides that the counterforce is a torsional force or a spring force acting on an actuating surface located at one end on the clamp carrier side. A torsional force could be produced, for example, by configuring the passage of the ends into the clamp carrier or by providing a flexible spring. On the other hand a spring force on an actuating surface can be achieved particularly simply since a simple helical spring can be used, which for example is held on a pin passing through its eye and can abut loosely against the actuating surface with its free end, where the actuating surface is connected to the end of the scissors leg on the clamp carrier side.

It is particularly advantageous that the clamp carrier according to the invention has a profiling on the fastening side for a wall contact or a profile contact. As a result, said clamp carrier can either be disposed directly on a wall if it has a plane rear side or held in a profile if it has a rear side adapted to the profile. This can be configured, for example, according to DE 10 2008 006 439.4

The invention is described in a preferred embodiment with reference to the drawings, where further details can be deduced from the figures in the drawings.

Functionally the same parts are provided with the same reference numbers.

Figure 2:
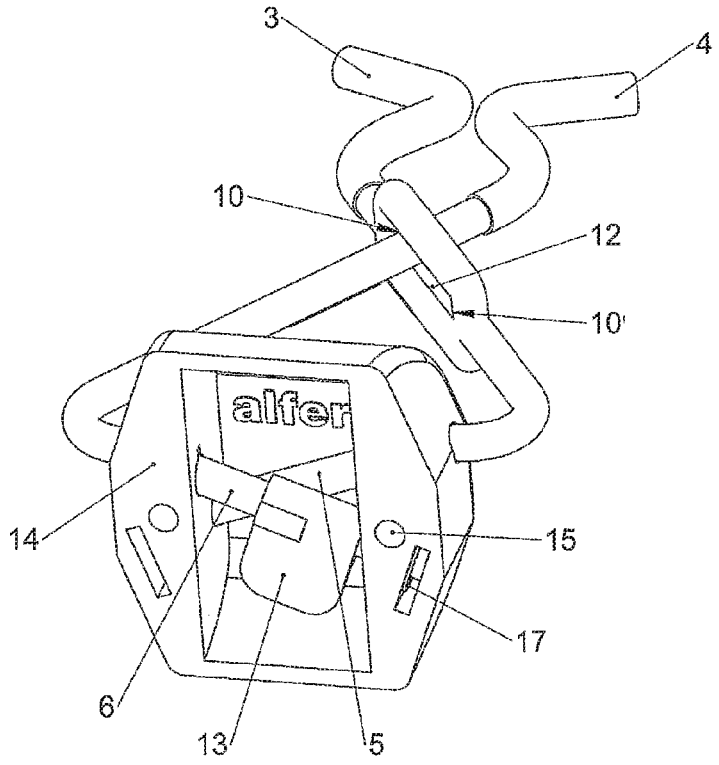
Figure 3:
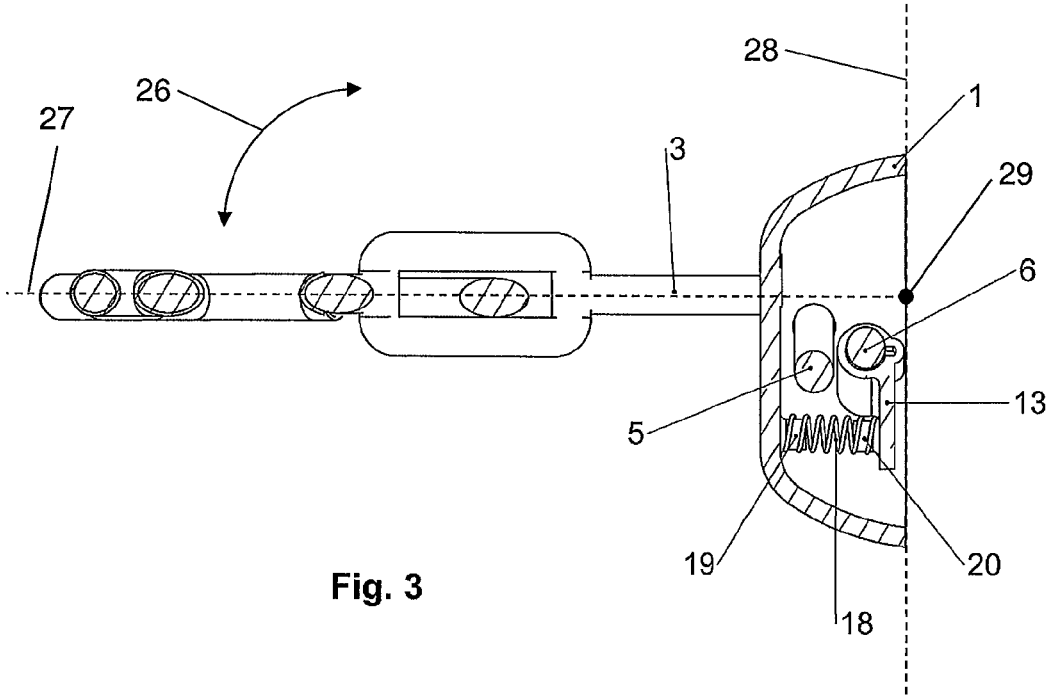
Figure 4:
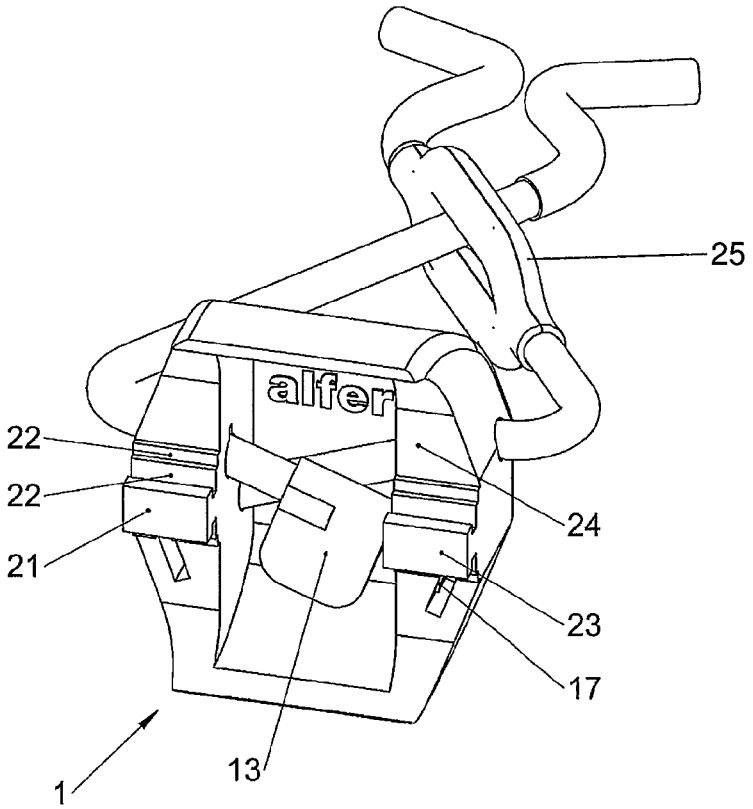
Figure 5:
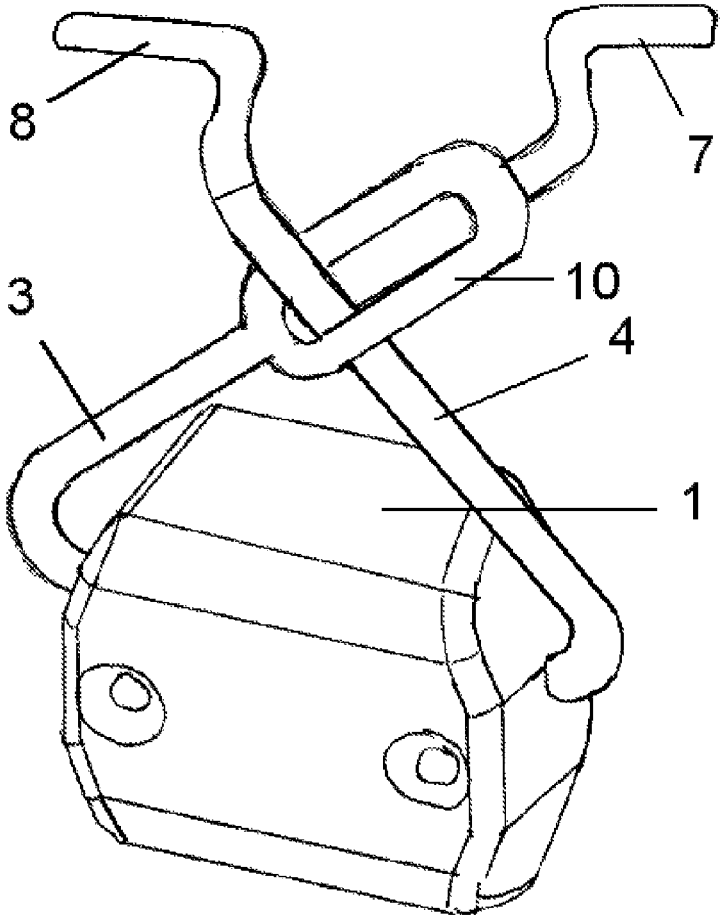

The figures of the drawings show in detail:

FIG. 1: shows a schematic perspective front view of an embodiment according to the invention, FIG. 2: shows a schematic perspective rear view of the same embodiment, FIG. 3: shows a schematic cutaway side view of the same embodiment and FIG. 4: shows a schematic perspective rear view of another embodiment, and FIG. 5: shows a schematic perspective rear view of the invention in its open, non-clamping vertical position.

FIG. 1 shows schematically in perspective front view an embodiment of the device holder according to the invention. The clamp carrier 1 which in this embodiment is to be fastened to a wall can be clearly seen. Through holes 15 which are penetrated by fastening means such as screws are used for this purpose. The embodiment according to the invention further comprises a pair of clamping scissors 2 formed by a first scissor leg 3 and a second scissor leg 4. These scissor legs have a diameter of 6 mm and consist of metal. Both scissor legs each have an end on the clamp carrier side which is rotatably arranged in the clamp carrier 1, to rotate in the pivoting up and down direction of the arrow 26 shown in FIGS. 1 and 3. The scissor legs are received and held in the interior of the clamp carrier 1. They also have a free end that forms the device receptacle 9. The first scissor leg 3 has a first free end 7 and the second scissor leg has a second free end 8. Both free ends 7, 8 are each bent correspondingly to one another and away from one another. As shown in FIG. 1, they can have a rubber coating 16 which increases the adhesive friction to a retained device, not shown, so that it is held more strongly and more safely. The two scissor legs 3 and 4 lie in a common plane which, in the horizontal clamping position of the clamping scissors 2 shown has a line of intersection with the fastening plane of the clamp carrier 1 which is aligned strictly horizontally. This is particularly important according to the invention in order not to produce any torque-producing horizontally offset points of application of the free ends 7 and 8 on the retained device not shown. The clamping scissors 2 can be pivoted from the horizontal clamping position shown, vertically upwards into an open position. In so doing, the position of the second scissor leg 4 with respect to the first scissor leg 3 changes. In the clamping position shown the second scissor leg 4 rests on a stop 10 which is formed by the inner wall of the front narrow side of the oblong hole 12. The oblong hole 12 at the same time forms a motion link for the second scissor leg 4, where the movement end positions thereof are formed by the front stop 10 in the clamping position and the rear stop 10' in the open position. The second scissor leg 4 is thereby restrictedly guided in the first scissor leg 3.

FIG. 2 shows schematically and perspectively a rear view of this embodiment in which the rear stop 10' can be seen more clearly. An embodiment in which the upper long side of the oblong hole 12 is omitted, so that instead a downwardly cranked section 11 would be obtained, would also be more feasible according to the invention. The second scissor leg 4 would be restrictedly guided in this as before. A front stop 10 and a rear stop 10' would also be found on the narrow sides. In this embodiment, it would also be feasible to provide the second scissor leg 4 with a second cranked section 11 which during movement of the clamping scissors into the open position would lead to a stop for the first scissor leg 3 since the position of both legs 3, 4 with respect to one another changes during the movement. The fastening-side profiling 14, which is a plane surface, as can be clearly seen on the rear side of the clamp carrier 1. The through holes 15 for the passage of fastening means not shown can also be clearly identified. The ends 5 and 6 of the two scissor legs 3 and 4 on the clamp carrier side can be identified, which pass through the housing wall and are held in the respectively opposite housing wall. A securing ring 17 which is pulled over the end 6 of the second scissor leg 4 on the clamp carrier side and prevents any displacement of the end 6 on the clamp carrier side can be identified. The actuating surface 13 fastened at this end, below which a helical spring 18 is located is also shown.

This is shown in FIG. 3 which shows a schematic side view in cutaway form. The actuating surface 13 is disposed on the end 6 on the clamp carrier side. The housing 1 and the actuating surface 13 have lugs 19 and 20 pointing towards one another, between which a helical spring 18 is located. The lugs 19, 20 penetrate into the respective eye of the helical spring 18. During the pivoting movement from the clamping position shown upwards into the open position shown in FIG. 5, the actuating surface 13 is moved towards the clamp carrier housing 1 and the helical spring 18 thereby tensioned. The counterforce thereby produced has the result that the device according to the invention in the rest position always has the clamping scissors 2 in the clamping position. The invention hereby very advantageously prevents the clamping scissors 2 or one of its scissor legs 3, 4 from remaining in the open position and the operator must thereby take a hand for assistance.

FIG. 4 shows schematically in perspective rear view a second embodiment of a clamp carrier 1 according to the invention. This embodiment differs from that described previously primarily through the configuration of the fastening-side profiling 14. This is configured so that it can be received in a profile and has a corresponding counter-profiling 21. This consists of a sliding block 23 and two contact planes 22 parallel to one another and spaced apart horizontally from one another and a bent rear wall section 24. Naturally any other profiling 21 is also feasible according to the invention. In this embodiment, sleeve 25 mounted on leg 3 includes an opening which forms a motion link for the second scissor leg 4, so that the second scissor leg 4 is restrictively guided by the first scissor leg 3.

REFERENCE LIST

1 Clamp carrier
2 Clamping scissors
3 First scissor leg
4 Second scissor leg

5 End on clamp carrier side
6 End on clamp carrier side
7 First free end
8 Second free end
9 Device receptacle
10 Stop
11 cranked section
12 Oblong hole
13 Actuating surface
14 Fastening-side profiling
15 Through hole
16 Rubber coating
17 Securing ring
18 Helical spring
19 Lug
20 Lug
21 Profile
22 Plane
23 Sliding block
24 Bent rear wall section
25 sleeve
26 arrow
27 line
28 line
29 point

The invention claimed is:

1. A device holder for clamping long-handled devices wherein the device holder is gravity dependent, comprising a clamp carrier adapted to be fastened to a wall or a retaining profile, a pair of clamping scissors that can be reversibly pivoted with respect to the clamp carrier from a horizontal clamping position to a vertical opening position, said pair of clamping scissors comprising two scissor legs, each leg having a bent end and a free end, wherein the bent ends are mounted to opposing sides of the clamp carrier, the two scissor legs movable relative to each other and rotatably arranged in the clamp carrier at the bent ends, a first one of the two scissor legs comprises an integral projecting portion that extends above and below a diameter of the first one of the two scissor legs and defines an oblong hole that is substantially aligned with a central axis of the first one of the two scissor legs, a second one of the two scissor legs penetrating the first one of the two scissor legs through the oblong hole wherein the legs cross one another and form a device receptacle there between characterized in that the receptacle and the free ends of the scissor legs lie in a plane whose line of intersection with a plane of the clamp carrier is horizontally oriented when the scissor legs are in the horizontal clamping position, and that the first one of the two scissor legs forms a motion link for the second one of the two scissor legs and limits pivoting motion of the second one of the two scissor legs into the clamping position by means of a stop.

2. The device holder according to claim 1, characterized in that the oblong hole is formed by a sleeve consisting of plastic or metal, that is mounted on the first one of the two scissor legs.

3. The device holder according to claim 1, characterized in that the pair of clamping scissors is pivotable against a counterforce into the opening position.

4. The device holder according to claim 3, characterized in that the counterforce is effective on at least one of the bent ends.

5. The device holder according to claim 3, characterized in that the counterforce is a torsional force or a spring force acting on an actuating surface located at one of the bent ends.

6. The device holder according to claim 1, characterized in that the clamp carrier has a profiling on a fastening side for a wall contact or a profile contact.

* * * * *